US008944849B1

(12) United States Patent
Yang et al.

(10) Patent No.: US 8,944,849 B1
(45) Date of Patent: Feb. 3, 2015

(54) ELECTRICAL CONNECTOR WITH TWO GROUND BARS CONNECTING EACH OTHER

(71) Applicant: Hon Hai Precision Industry Co., Ltd., New Taipei (TW)

(72) Inventors: Wen-Hui Yang, New Taipei (TW); Chien-Ping Kao, Hershey, PA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 8 days.

(21) Appl. No.: 13/950,295

(22) Filed: Jul. 25, 2013

(51) Int. Cl.
*H01R 13/648* (2006.01)
*H01R 13/6585* (2011.01)

(52) U.S. Cl.
CPC ..... *H01R 13/6585* (2013.01)
USPC ..... 439/607.07

(58) Field of Classification Search
CPC ..... H01R 23/688; H01R 4/646
USPC ..... 439/607.07, 607.08, 108, 100, 607, 5, 439/98
See application file for complete search history.

(56) References Cited

U.S. PATENT DOCUMENTS

| | | | | |
|---|---|---|---|---|
| 6,752,640 | B2 * | 6/2004 | Chen | 439/92 |
| 6,971,916 | B2 * | 12/2005 | Tokunaga | 439/607.09 |
| 7,104,943 | B2 * | 9/2006 | Brintazzoli et al. | 493/405 |
| 7,381,092 | B2 * | 6/2008 | Nakada | 439/607.1 |
| 2009/0221167 | A1 | 9/2009 | Pittenger et al. | |
| 2014/0080331 | A1 * | 3/2014 | Jeon | 439/84 |
| 2014/0248785 | A1 * | 9/2014 | Little et al. | 439/95 |

* cited by examiner

*Primary Examiner* — Phuongchi T Nguyen
(74) *Attorney, Agent, or Firm* — Wei Te Chung; Ming Chieh Chang

(57) ABSTRACT

An electrical connector includes an insulating housing and a plurality of contacts. The contacts include a plurality of signal contacts arranged in differential signal pairs and a plurality of ground contacts. Differential signal pairs are separated by signal contacts. A first ground bar connects each ground contact to form a first electrical connection. A second ground bar connects each ground contact to form a second electrical connection. The first ground bar is electrically connected to the second ground bar through at least a bridge.

12 Claims, 7 Drawing Sheets

ELECTRICAL CONNECTOR WITH TWO GROUND BARS CONNECTING EACH OTHER

BACKGROUND OF THE INVENTION

1. Field of the Invention

The present invention relates to an electrical connector, especially to a high-frequency electrical connector.

2. Description of Related Art

US Pat. No. US2009/0221165 discloses a high-frequency connector up to 6 Gbps, which comprises a housing loading a plurality of electrical contacts. The electrical contacts include a plurality of signal contacts and a plurality of ground contacts. A shieldless ground coupling assembly places at least a portion of the ground contacts in electrical communication with each other. The only one ground bar fails to meet a high-frequency performance up to 12 Gbps.

Hence, an electrical connector of a high-frequency performance is desired.

BRIEF SUMMARY OF THE INVENTION

Accordingly, an object of the present invention is to provide an electrical connector with a high-frequency performance.

To achieve the above object, an electrical connector comprises an insulating housing and a plurality of contacts. The contacts include a plurality of signal contacts arranged in differential signal pairs and a plurality of ground contacts. Every two adjacent differential signal pairs is separated by a ground contact. A first ground bar connects each ground contact to form a first electrical connection. A second ground bar connects each ground contact to form a second electrical connection. The first ground bar is electrically connected to the second ground bar through at least a bridge.

Other objects, advantages and novel features of the invention will become more apparent from the following detailed description when taken in conjunction with the accompanying drawings.

DETAILED DESCRIPTION OF THE PREFERRED EMBODIMENTS

Figure 1:
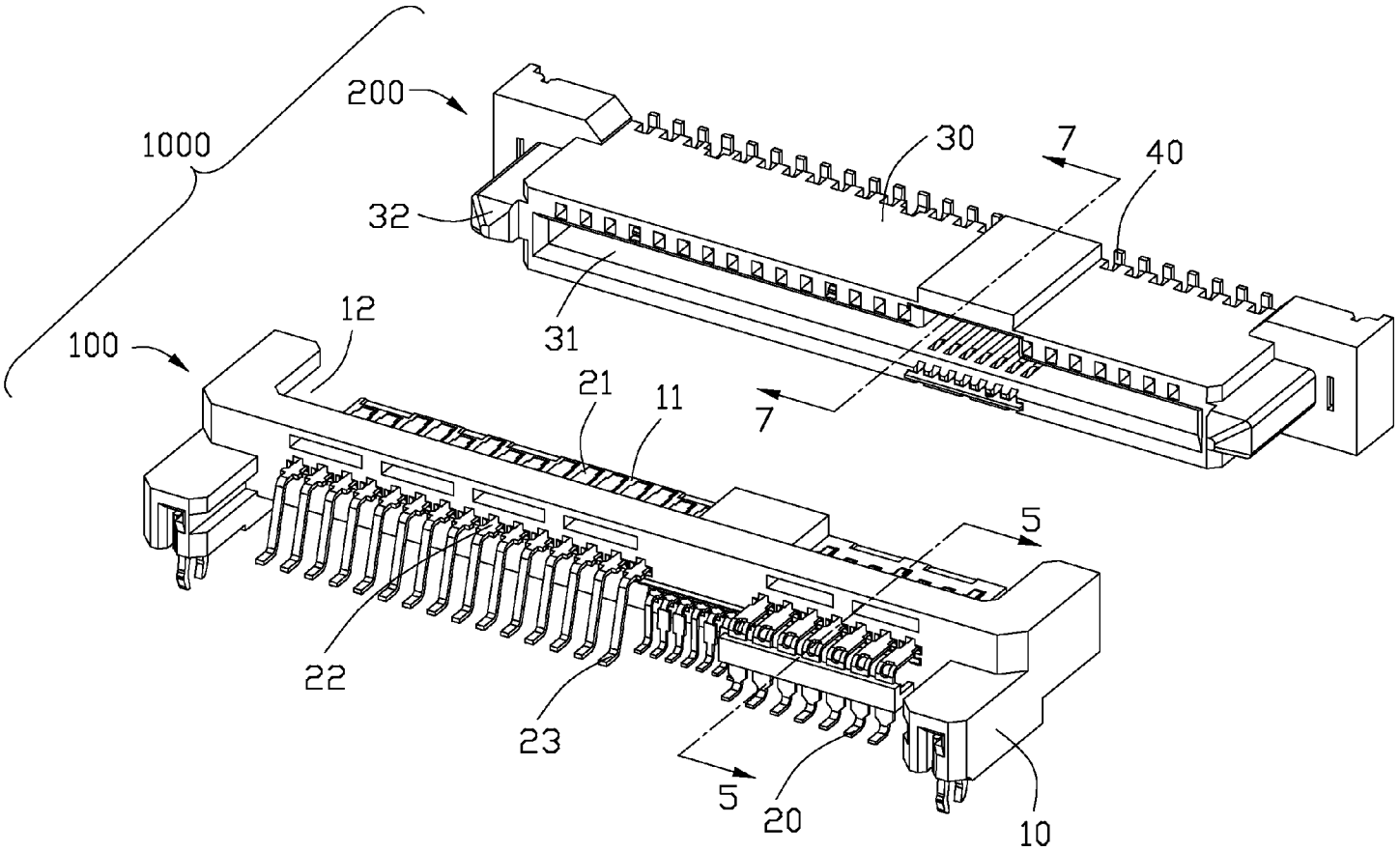
FIG. 1 is a perspective view of an electrical connector assembly in accordance with a preferred embodiment of the present invention.

Reference will now be made to the drawing figures to describe the preferred embodiment of the present invention in details. FIG. 1 illustrates an electrical connector assembly 1000 to transmit high frequency signals, which comprises a first electrical connector 100 in a plug connector type and a second electrical connector 200 in a receptacle connector type, mating with each other along a mating direction. The first electrical connector 100 comprises an insulating housing 10 and several plug contacts 20 loaded in the insulating housing 10. The second electrical connector 200 comprises an insulating housing 30 and a plurality of receptacle contacts 40 loaded in the insulating housing 30. The first electrical connector 100 defines a mating tongue 11 intending to be inserted into a mating slot 31 defined by the second electrical connector 200. A pair of guiding posts 32 of the second electrical connector 200 is guided into a corresponding pair of U shaped guiding recesses 12 of the first electrical connector 100.

Figure 2:
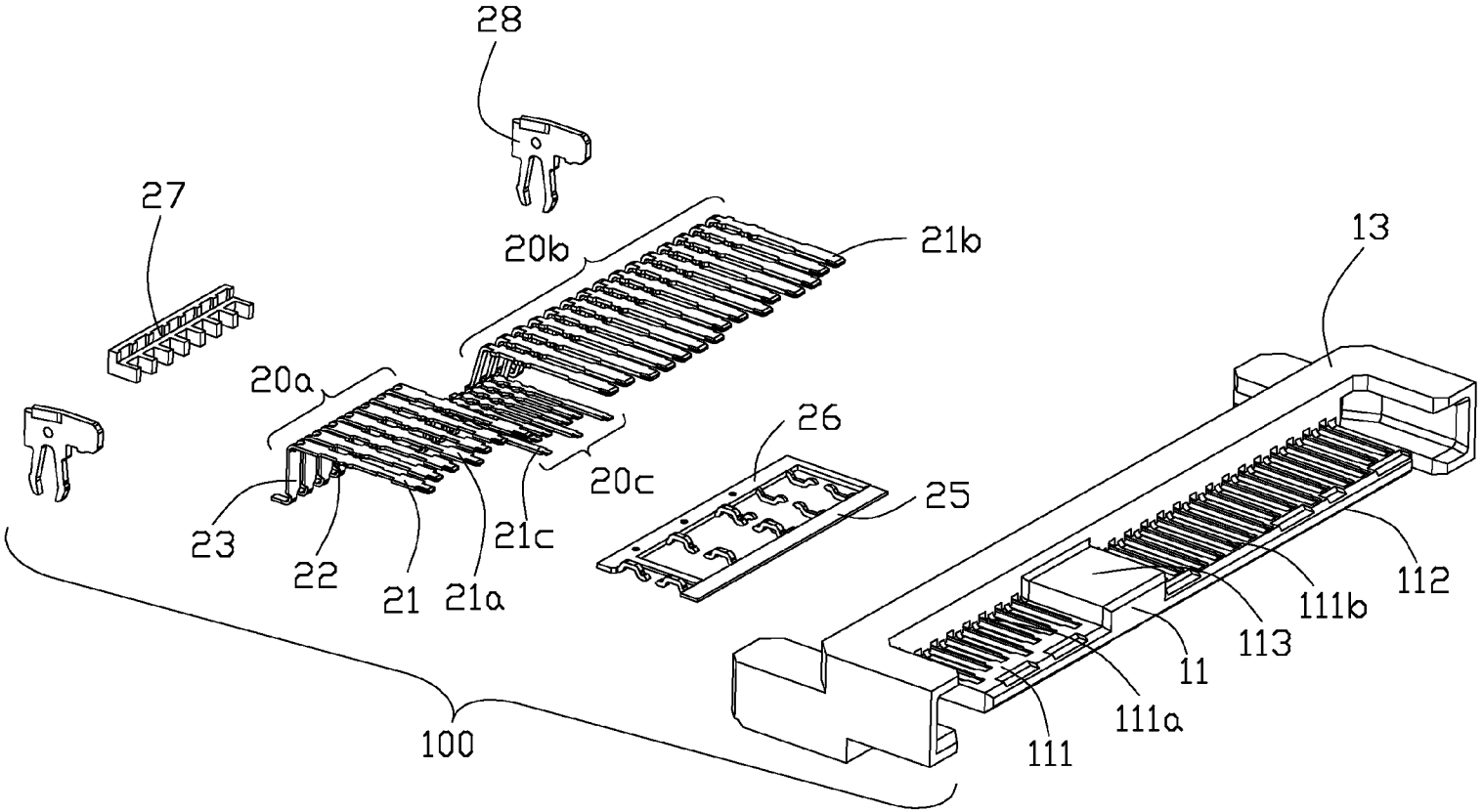
FIG. 2 is an exploded perspective view of a first electrical connector of the assembly as shown in FIG. 1.
Figure 3:
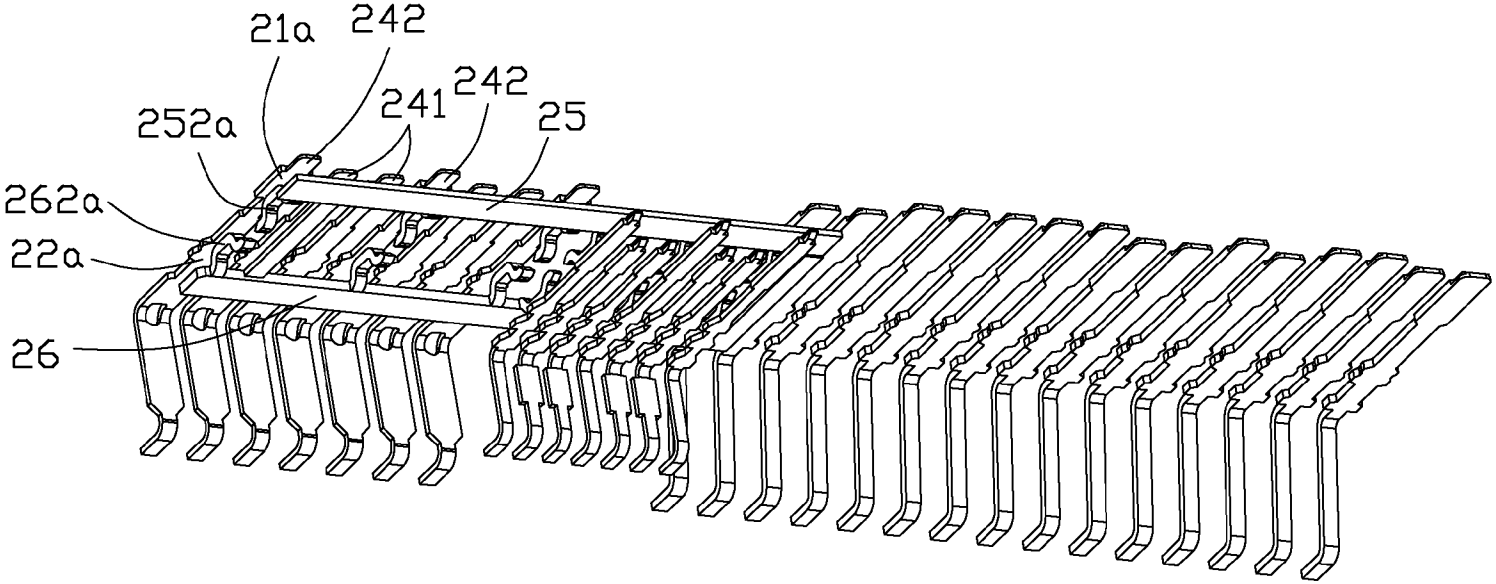
FIG. 3 is a perspective view of contacts and two ground bars of the first electrical connector in FIG. 2.

Referring to FIG. 2 to FIG. 3, the mating tongue 11 extends from a base 13 of the insulating housing 10 along the mating direction and a lengthwise direction perpendicular to the mating direction. The mating tongue 11 defines an upper face 111, an opposite lower face 112 and a protrusion 113 on the upper face 111. The upper face 111 is divided into a first area 111*a* and a second area 111*b* by said protrusion 113. The plug contacts 20 are of plate form, each has a contacting portion 21 embedded in the mating tongue 11, a retaining portion 22 retained in the mating tongue or/and base 13 and a leg portion 23 extending out of a rear face of the base 13. The retaining portion 22 joints the contacting portion 21 and the soldering portion 23. The first contacts 20 are arranged into three groups 20*a*, 20*b*, 20*c* along the mating tongue 11. The contacting portions 21*a*, 21*b* of the first and second groups 20*a*, 20*b* of the contacts are located at the first and second areas 111*a*, 111*b* of the upper face 111. The contacting portions 21*c* of the third group 20*c* of contacts are located at the lower face 112 and corresponding to the protrusion 113. The first and third groups of contacts 20*a*, 20*c* are used to transmit data signals while the second group of contacts 20*b* is used to transmit power signals.

Figure 4:
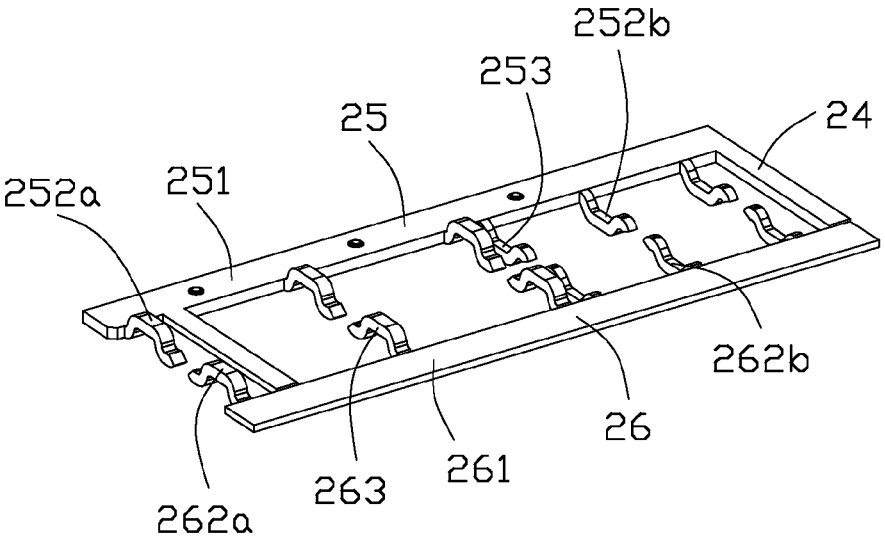
FIG. 4 is a perspective view of the ground bars.
Figure 5:
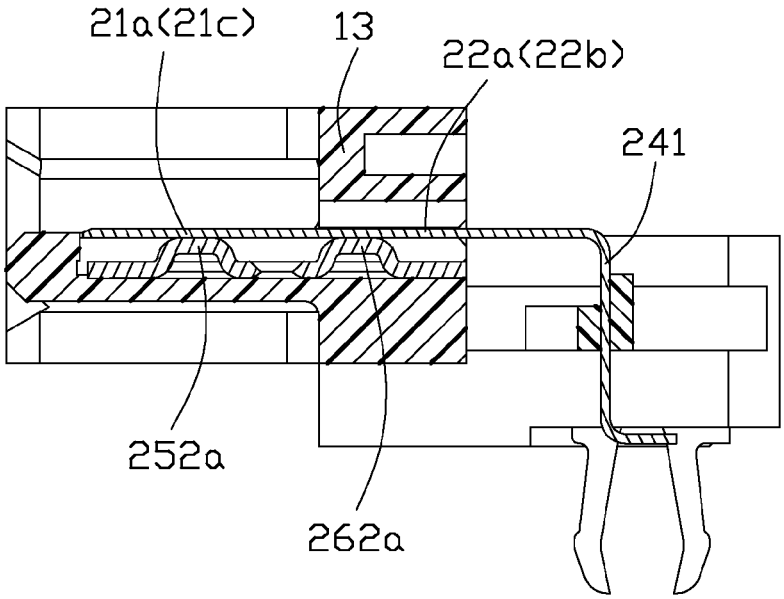
FIG. 5 is a cross sectional view of the first electrical connector taken along lines 5-5 in FIG. 1.
Figure 6:
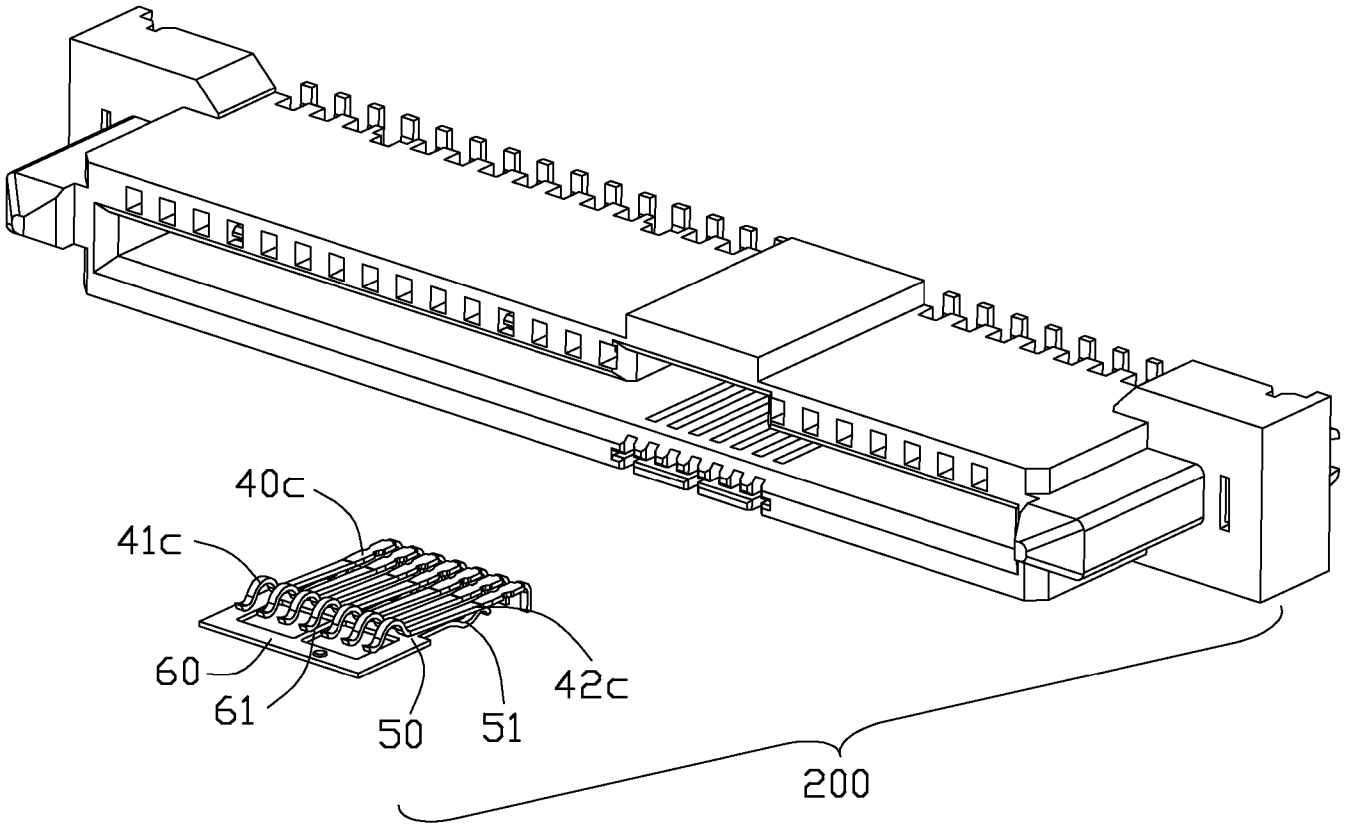
FIG. 6 is a partially exploded view of the second electrical connector.
Figure 7:
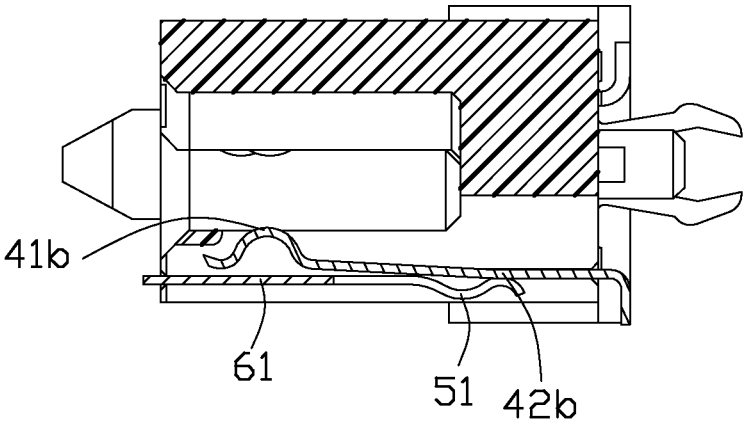
FIG. 7 is a cross sectional view of the second electrical connector taken along lines 7-7 in FIG. 1.

Each of the first and third groups 20*a*, 20*c* of contacts includes two pairs of differential signal pair 241 and three individual ground contacts 242 separating two pairs of the signal pair. Combination with FIGS. 3 and 4, a first ground bar 25 and a second ground bar 26 are provided to connect the individual ground contacts 241, the first ground bar 25 includes a beam 251 and a plurality of first elastic arms 252*a* and second elastic arms 252*b*. The second ground bar 26 includes a beam 261 and a plurality of first elastic arms 262*a* and second elastic arms 262*b*. The first and second ground bars are retained in the insulating housing, the first ground bar 25 is loaded in the mating tongue 11 and the second ground bar 26 is retained in the base 13. The first elastic arms 252*a*, 262*a* of the first and second ground bars 25, 26 touch the contacting portions 21*a*, 21*c* of the contacts 20*a*, 20*c*. The second elastic arms 252*b*, 262*b* of the first and second ground bars 25, 26 touch the retaining portions 22*a*, 22*c* of the contacts 20*a*, 20*c*. The first elastic arms 252*a*, 262*a* each defines a downward opening 253 while the second elastic arms 252*b*, 262*b* each defines an upward opening 263. The elastic arms 252*a*, 252*b* of the first ground bar 25 are symmetric to the elastic arms 262*a*, 262*b* of the second ground bar 26 with respect to an invisible line. The first ground bar 25 is also symmetric to the second ground bar 26 with respect to said invisible line.

The first ground bar 25 is electrically connected to the second ground bar 26 via two bridges 24 so as to form a closed circuit. The closed circuit can decrease voltage distribution among the elastic arms or among ground contacts. The crosstalk between the differential pairs will be reduced because of little voltage distribution. The two bridges are parallel to each other. One bridge is also acceptable and the high-frequency performance may be little worse than two bridges. Please mention that the bridges won't align with the third group 20*c* of contacts from a top-to-bottom view for little pitch between adjacent contacts.

A spacer 27 is provided to used to retain the soldering portions of the first series of contacts 20*a*. The retaining elements 28 are attached to a PCB after being assembled to the insulating housing 10.

The second electrical connector 200 comprises insulating housing 30, contacts 40 assembled on the insulating housing. A first ground bar 50 includes several elastic arms connecting retaining portions of the ground contacts of a group of contacts 40*c*. A second ground bar 60 includes several plate-shaped bridges 61 connecting the first ground bar 50. When the first electrical connector 100 mates with the electrical second connector 200, the contacting portions 41*c* of the second electrical connector will be deformed by the contacting portions 21*c* of the first electrical connector and touch the bridges 61. It is noted that the housing 30 is composed of two opposite side walls sandwiching the mating slot 31 therebetween wherein one of the side walls defines a cutout without the contacts 40 therein while the other of the side walls has the contact 40 located only vertically in alignment with the cutout. In addition, the side wall having the cutout defines an outwardly protruding region on an exterior surface in alignment with the cutout along the vertical direction while the side wall without said cutout defines an even exterior surface thereof.

While preferred embodiments in accordance with the present invention has been shown and described, equivalent modifications and changes known to persons skilled in the art according to the spirit of the present invention are considered within the scope of the present invention as defined in the appended claims.

What is claimed is:

1. An electrical connector, comprising:

an insulating housing;

a plurality of contacts extending in a front-to-back direction and comprising differential signal pairs and individual ground contacts;

a first ground bar connecting with said ground contacts to form a first electrical connection;

a second ground bar connecting with said ground contacts to form a second electrical connection;

wherein the first ground bar is electrically connected to the second ground bar through at least a bridge;

wherein the first ground bar and the second ground bar extend along a transverse direction perpendicular to said front-to-back direction, and are located at a different lever with regard to the contacts, and said bridge extends along the front-to-back direction while not aligned with any of the differential signal pairs in a vertical direction perpendicular to both said front-to-back direction and said transverse direction;

wherein said contacts are of two groups with different pitches thereof, and each of said first ground bar and the second ground bar defines arms contacting both two groups;

wherein the contacts of said two groups are located at two different levels while the first ground bar and the second ground bar are located a same level;

wherein the contacts of said two groups are disposed in a same mating tongue but on two opposite surfaces thereof, and the arms contacting said two groups extend in different levels, respectively;

the elastic arms which extend from a body of the first ground bar are offset from the elastic arms which extend from a body of the second ground bar.

2. The electrical connector as claimed in claim 1, wherein the first and second ground bars form a closed circuit through being connected with each other by two bridges.

3. The electrical connector as claimed in claim 1, wherein the at least a bridge is located between two elastic arms of the first or second ground bar.

4. The electrical connector as claimed in claim 1, wherein each ground contact defines a plurality of elastic arms and the elastic arms touch the two ground bars.

5. The electrical connector as claimed in claim 4, wherein a first group of said elastic arms each defines a first opening while a second group of said elastic arms each defines an opposite second opening to the first opening.

6. The electrical connector as claimed in claim 4, wherein the elastic arms of the first ground bar and the elastic arms of the second ground bar are aligned along a direction parallel to the bridge.

7. An electrical connector assembly comprising:

a first electrical connector comprising a first insulating housing with a plurality of contacts and two first ground bars, said contacts includes differential signal pairs and ground contacts, said first ground bars electrically connects said ground contacts respectively;

a second electrical connector mating with said first electrical connector and comprising a second insulating housing with a plurality of contacts and two second ground bars, said contacts includes differential signal pairs and ground contacts, one of the second ground bar electrically connects said ground contacts respectively;

wherein said first ground bars are electrically connected to each other and said second ground bars are electrically connected to each other;

wherein the first ground bar and the second ground bar extend along a transverse direction perpendicular to said front-to-back direction, and are located at a different lever with regard to the contacts, and said bridge extends along the front-to-back direction while not aligned with any of the differential signal pairs in a vertical direction perpendicular to both said front-to-back direction and said transverse direction;

wherein said contacts are of two groups with different pitches thereof, and each of said first ground bar and the second ground bar defines arms contacting both two groups;

wherein the contacts of said two groups are located at two different levels while the first ground bar and the second ground bar are located a same level;

wherein the contacts of said two groups are disposed in a same mating tongue but on two opposite surfaces thereof, and the arms contacting said two groups extend in different levels, respectively;

the elastic arms which extend from a body of the first ground bar are offset from the elastic arms which extend from a body of the second ground bar.

8. The electrical connector assembly as claimed in claim 7, wherein the other of said second ground bars of the second electrical connector touch the ground contacts of the first electrical connector while mating with corresponding contacts of the first electrical connector.

9. An electrical connector assembly comprising:

an insulative housing extending along a transverse direction;

a plurality of contacts disposed in the housing and arranged in at least one row along the transverse direction while each of said contacts extending along a front-to-back direction perpendicular to said transverse direction, said contacts being categorized with differential pairs and grounding contacts;

a grounding device extending along the transverse direction and located at a different level with regard to the contacts in a vertical direction perpendicular to both said front-to-back direction and said transverse direction; and means for forming on the grounding device electrically and mechanically connecting at least one of said grounding contacts at two spaced positions along said front-to-back direction;

wherein said grounding device includes first and second grounding bars spaced from each other in the front-to-back direction while each extending along the transverse direction;

wherein said means for having resilient arms respectively extending from said first grounding bar and said second bar to contact the same grounding contact at said two spaced positions, respectively;

wherein said first grounding bar and said second grounding bar are linked by at least one bridge extending along the front-to-back direction;

wherein said bridge is not aligned with any differential pairs in the vertical direction;

the elastic arms which extend from a body of the first ground bar are offset from the elastic arms which extend from a body of the second ground bar.

10. The electrical connector assembly as claimed in claim 9, wherein said resilient arms extend in an opposite manner along the front-to-back direction to contact the same grounding contact.

11. The electrical connector assembly as claimed in claim 9, wherein said housing defines a receiving slot along said transverse direction between two side walls, said contacts are arranged in two rows respectively in said two side walls confronting the receiving slot in the vertical direction, one of said two side walls defines an interior cutout with the contacts thereon and the other of said two side walls have the contacts only confront said cutout, the side wall with said cutout defines an outwardly protruding region in alignment with said cutout on an exterior surface thereon while the side wall without said cutout defines an even exterior surface thereon.

12. The electrical connector assembly as claimed in claim 11, wherein the grounding device communicates with an exterior in a vertical direction through the corresponding side wall.

* * * * *